US006924478B1

(12) United States Patent
Zubarev et al.

(10) Patent No.: US 6,924,478 B1
(45) Date of Patent: Aug. 2, 2005

(54) TANDEM MASS SPECTROMETRY METHOD

(75) Inventors: Roman Zubarev, Sigtuna (SE); Gökhan Baykut, Bremen (DE); Matthias Witt, Lilienthal (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/848,516

(22) Filed: May 18, 2004

(51) Int. Cl.[7] ..... H01J 49/00
(52) U.S. Cl. ..... 250/282; 250/292; 250/296
(58) Field of Search ..... 250/282, 281, 250/285, 292, 296, 298

(56) References Cited

U.S. PATENT DOCUMENTS 5,055,677 A * 10/1991 Amirav et al. ..... 250/282

OTHER PUBLICATIONS

Horn, David et al., "Automated *de novo* sequencing of proteins by tandem high-resolution mass spectrometry", vol. 97, No. 19, PNAS, Sep. 12, 2000, pp. 10313-10317.
Haselmann, Kim F., et al., "Advantages of External Accumulation for Electron Capture Dissociation in Fourier Transform Mass Spectrometry", Vo1. 73, No. 13, Anal. Chem., 2001, pp. 2998-3005.
Tsybin, Youri O., et al., "Combined infrared multiphoton dissociation and electron capture dissociation with a hollow electron beam in Fourier transform ion cyclotron resonance mass spectrometry", Rapid Communication In Mass Spectrometry, vol. 17, John Wiley & Sons, Ltd., 2003, pp. 1759-1768.
Budnik, Bogdan A., et al., "Electron detachment dissociation of peptide dianions: an electron-hole recombination phenomenon", Chemical Physics Letters, vol. 342, Elsevier Science B.V., 2001, pp. 299-302.
Zubarev, Roman A., "Reactions of Polypeptide Ions With Electrons In The Gas Phase", Mass Spectrometry Reviews, vol. 22, Wiley Periodicals, Inc., 2003, pp. 57-77.
Kjeldsen, Frank, et al., "Dissociative capture of hot (3-13 eV) electrons by polypeptide polycations: an efficient process accompanied by secondary fragmentation", Chemical Physics Letters, vol. 356, Elsevier Science B.V., 2002, pp. 201-206.
Kjeldsen, Frank, et al. "Complete Characterization of Post-translational Modification Sites in the Bovine Milk Protein PP3 by Tandem Mass Spectrometry with Electron Capture Dissociation as the Last Stage", vol. 75, No. 10, American Chemical Society, 2003, pp. 2355-2361.
Zubarev, Roman A., et al., "Electron Capture Dissociation of Multiply Charged Protein Cations. A Nonergodic Process", vol. 120, American Chemical Society, 1998, pp. 3265-3266.

* cited by examiner

*Primary Examiner*—Kiet T. Nguyen

(57) ABSTRACT

Multiply charged ions are trapped and accumulated in a spatially limited region before being injected into an ion trap mass spectrometer such as a Fourier transform ion cyclotron resonance mass spectrometer (FTICR MS). In the ion trap electron capture dissociation (ECD) and vibrational excitation dissociation are sequentially applied on ions of the same ion ensemble. The first dissociation process does not fragment all primary ions. Following the detection of the dissociation products, the primary ions that remain undissociated undergo the vibrational excitation and again, a part of them dissociate, and the fragments are detected. Thus, the same ion ensemble is used for two fragmentation processes. During these processes, further ions generated in the external ion source are accumulated in the spatially limited region for subsequent analyses.

27 Claims, 5 Drawing Sheets

TANDEM MASS SPECTROMETRY METHOD

FIELD OF THE INVENTION

The present invention relates to a tandem mass spectrometry method for structural analysis.

BACKGROUND OF THE INVENTION

In mass spectrometry sample molecules are ionized and then the ions are analyzed to determine their mass-to-charge (m/z) ratios. The ions can be produced by a variety of ionization techniques, including electron impact, fast atom bombardment, electrospray ionization (ESI) and matrix-assisted laser desorption ionization (MALDI). The analysis by m/z is performed in analyzers in which the ions are either trapped for a period of time or fly through towards the ion detector. In the ion trapping analyzers, such as radiofrequency quadrupole ion trap (Paul trap), linear ion trap and ion cyclotron resonance (ICR) analyzers (Penning trap), the ions are spatially confined by a combination of magnetic, electrostatic or alternating electromagnetic fields for a period of time typically from about 0.1 to 10 seconds. In the transient-type mass analyzers, such as magnetic sector, quadrupole, and time-of-flight analyzers, the residence time of ions is shorter, in the range of about 1 to 100 $\mu$s.

Tandem mass spectrometry is a general term for mass spectrometric techniques where sample ions (precursor ions) of desired m/z values are selected and dissociated inside the mass spectrometer and the obtained fragment ions are analyzed according to their m/z values. Dissociation of mass-selected ions can be performed in a special cell between two m/z analyzers. This cell is usually a multipole ion trap, i.e. quadrupole, hexapole, etc. ion trapping device. In ion trap mass spectrometry instruments, the dissociation occurs inside the trap (cell). Tandem mass spectrometry can provide much more structural information on the sample molecules.

Tandem mass spectrometry is a general term for mass spectrometric techniques, where sample ions (precursor ions) of desired m/z values are selected and dissociated inside the mass spectrometer once (MS/MS or $MS^2$) or multiple times (n-times: $MS^n$) before the final mass analysis takes place.

To fragment the ions in the mass spectrometer, collision-induced dissociation (CID) or infrared multiphoton dissociation (IRMPD) are most commonly employed. Both of these techniques produce vibrational excitation (VE) of precursor ions above their threshold for dissociation. In collision-induced dissociation, VE is achieved when precursor ions collide with gas atoms or molecules, such as e.g. helium, argon or nitrogen, with subsequent conversion of the collisional energy into internal (vibrational) energy of the ions. Alternatively, the internal energy may be increased by sequential absorption of multiple infrared (IR) photons when the precursor ions are irradiated with an IR laser. These precursor ions with high internal energy undergo subsequent dissociation into fragments (infrared multiphoton dissociation, IRMPD), one or more of which carry electric charge. The mass and the abundance of the fragment ions of a given kind provide information that can be used to characterize the molecular structure of the sample of interest.

All VE techniques have serious drawbacks. Firstly, low-energy channels of fragmentation always dominate, which can limit the variety of cleaved bonds and thus reduce the information obtained from fragmentation The presence of easily detachable groups results in the loss of information on their location. Finally, both collisional and infrared dissociations become ineffective for large molecular masses.

To overcome these problems, a number of ion-electron dissociation reactions have been proposed (see the review by Zubarev, Mass Spectrom. Rev. (2003) 22:57–77). One such reaction is electron capture dissociation (ECD) (see Zubarev, Kelleher and McLafferty *J. Am. Chem. Soc.* 1998, 120, 3265–3266). In the ECD technique, positive multiply-charged ions dissociate upon capture of low-energy (<1 eV) electrons produced either by a heated filament, or by a dispenser cathode as in Zubarev et al. *Anal. Chem.* 2001, 73, 2998–3005. Electron capture can produce more structurally important cleavages than collisional and infrared multiphoton dissociations. In polypeptides, for which mass spectrometry analysis is widely used, electron capture cleaves the N—$C_\alpha$ backbone bonds, while collisional and infrared multiphoton excitation cleaves the amide C—N backbone bonds (peptide bonds). Moreover, disulfide bonds inside the peptides, that usually remain intact in collisional and infrared multiphoton excitations, fragment specifically upon electron capture. Finally, some easily detachable groups remain attached to the fragments upon electron capture dissociation, which allows the determination of their positions. This feature is especially important in the analysis of post-translational modifications in proteins and peptides, such as phosphorylation, glycosylation, $\gamma$-carboxylation, etc. as the position and the identity of the post translationally attached groups are directly related to the biological function of the corresponding peptides and proteins in the organism.

Other ion-electron fragmentation reactions also provide analytical benefits. Increasing the electron energy to 3–13 eV leads to hot-electron capture dissociation (HECD), in which electron excitation precedes electron capture. The resulting fragment ions undergo secondary fragmentation, which allows to distinguish between the isomeric leucine and isoleucine residues (see Kjeldsen, Budnik, Haselmann, Jensen, Zubarev, Chem. Phys. Lett. 2002, 356, 201–206). In electron detachment dissociation (EDD) introduced by Budnik, Haselmann and Zubarev (Chem. Phys. Lett. 2001, 342, 299–302), 20 eV electrons ionize peptide di-anions, which produces effect similar to ECD. EDD is advantageous for acidic peptides and peptides with acidic modifications, such as sulfation.

In order to make the bookkeeping of the hydrogen atom transfer to and from the fragments easier, the "prime" and "dot" notation has been introduced. In this notation the presence of an unpaired electron is always noted with a radical sign ".", e.g. homolytic N—$C_\alpha$ bond cleavage gives c. and z. fragments. Hydrogen atom transfer to the fragment is denoted by a "'", e.g. hydrogen transfer to c. gives c' species, while hydrogen atom loss from z. results in z' fragments.

Combined use of ion-electron fragmentation reactions with VE techniques provides additional sequence information (see Horn, Zubarev and McLafferty, Proc. Natl. Acad. Sci. USA, 2000, 97, 10313–10317). First, ion-electron reactions produce not only more abundant, but also different kind of cleavage (e.g. N—$C_\alpha$ bond cleavage giving $c'_n$ and $z.'_n$ ions) than VE techniques (C—N bond cleavage yielding $b_n$ and $y'_n$ ions). Comparison between the two types of the cleavage allows one to determine the type of the fragments. For example, the mass difference between the N-terminal $c'_n$ and $b_n$ ions is 17 Da, while that between the C-terminal y' and z. ions is 16 Da. Second, the cleavage sites are often complementary. For instance, VE techniques cleave preferentially at the N-terminal side of the proline residues, while this site is immune to ECD. On the other hand, ECD cleaves S—S bonds preferentially, while these bonds remain intact in most VE experiments. Finally, polypeptides with post-translational modifications exhibit in VE characteristic losses, which allows one to identify the presence and type of the modification. At the same time, ECD affords determination of the sites of modifications (see Kjeldsen, Haselmann, Budnik, Sørensen and Zubarev, R. A. *Anal. Chem.* (2003), 2003, 75:2355–2361). Although ion-electron reactions can be used simultaneously with VE techniques, the complementary character of the analytical information obtained in these techniques favors independent consecutive use of them (Tsybin, Witt, Baykut, Kjeldsen, and H åkansson, *Rapid. Commun. Mass Spectrom.* 2003, 17, 1759–1768).

A drawback of current tandem mass spectrometry utilizing both ion-electron reactions and VE techniques is that the consecutive use of these reactions demands at least twice as much time for the analysis as is required by the fastest of these techniques. This time of the analysis is especially critical while analyzing low-concentration samples, which is the case in biological mass spectrometry where the sample quantity is often limited. Low-concentration samples require either long (several seconds) accumulation of the precursor ions in the trapping device, or integration of many individual MS/MS spectra. In both cases, the time loss due to the consecutive use of ion-electron reactions and VE techniques can be in the order of several seconds. This severely limits the analytical utility of tandem mass spectrometry when it is combined with the separation techniques, such as liquid chromatography (HPLC) or capillary electrophoresis (CE), where the entire signal from an individual compound often lasts for just a short period of time not exceeding some seconds. Therefore, while separating or simultaneously using VE and ion-electron reactions on-line with both HPLC and CE has been demonstrated, consecutive use of these fragmentation techniques on-line with separation techniques, although deemed highly advantageous in e.g. Kjeldsen, Haselmann, Budnik, Sørensen and Zubarev, *Anal. Chem.* 2003, 75, 2355–2361, has not been achieved yet because of the time-of-analysis limitations.

SUMMARY OF THE INVENTION

According to the present invention, methods are provided for reducing the time of analysis (alternatively, increasing the sensitivity for fixed analysis time) in tandem mass spectrometry employing an ion trapping device with consecutive use of an ion-electron reaction and a vibrational excitation technique. The positive effect is achieved by using the same population of precursor ions for independent and consecutive use of both kinds of ion excitation. The invention provides means for first employing one type of reactions with subsequent analysis of the m/z values of the fragment ions, but not of the unreacted precursor ions. The latter remain trapped in the cell and undergo the second kind of reaction, while means are provided for subsequent analysis of the m/z values of the fragments. Thus, for each precursor ion population accumulated in the ion trap, two independent fragmentation mass spectra are recorded, one each for each of the fragmentation techniques employed, by means of which the total analysis time is reduced by the time interval corresponding to accumulation of precursor ions in the trap for the second fragmentation reaction. Thus, time reduction close to 50% can be achieved. Alternatively, for a fixed total analysis time, the accumulation time for precursor ions can be doubled, which should lead to increase in the sensitivity by a factor of two or higher.

BRIEF DESCRIPTION OF THE DRAWINGS

The above and further advantages of the invention may be better understood by referring to the following description in conjunction with the accompanying drawings in which.

DETAILED DESCRIPTION

Figure 1:
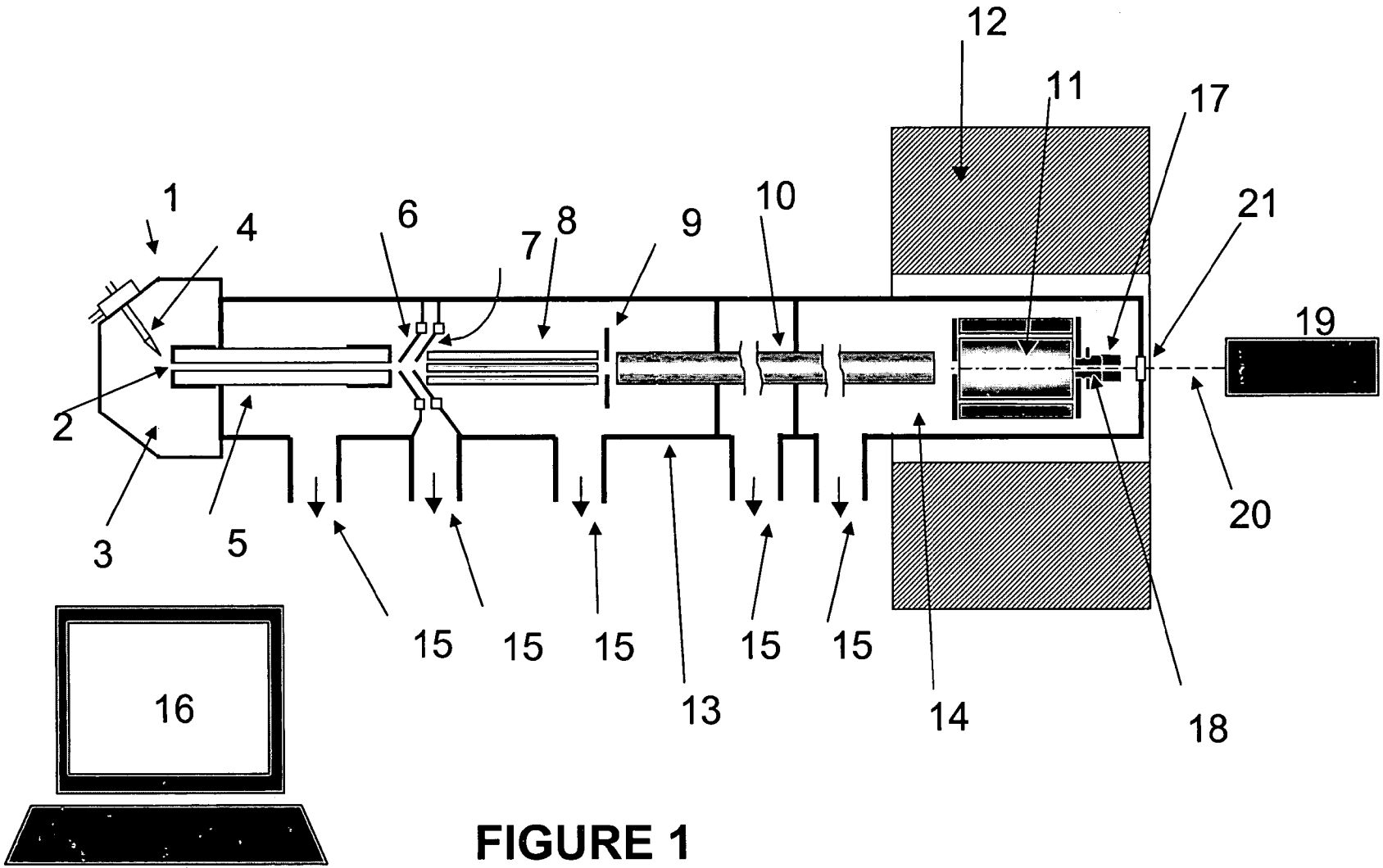
FIG. 1 is a diagram of a Fourier transform ion cyclotron resonance mass spectrometer according to the present invention.

A method of the present invention for reducing the time of analysis, or increasing the sensitivity for a fixed analysis time, in tandem mass spectrometry may involve several steps. These include providing a beam of positive or negative precursor ions that accumulate during a certain period of time in a spatially limited region, and using a radiofrequency potential or potentials to confine these precursor ions within the region for a period of time. The ions are then transported to a static or dynamic electromagnetic ion trap or into a radiofrequency ion trap in which said precursor ions are confined for a period of time. A beam of electrons is provided inside the trap with sufficiently low kinetic energy, e.g., below approximately 20 eV, to allow ion-electron reactions, in which at least a fraction of the ions, but not all of them, dissociate into fragments. The fragments are then analyzed by their mass-to-charge ratios. A vibrational excitation is then applied to the unreacted ions, by means of which said ions dissociate into fragments. The vibrational excitation fragments are then analyzed by their mass-to-charge ratios, thereby allowing separate recording of fragment mass spectra from both ion-electron reactions and vibrational excitation from the same population of said precursor ions.

The spatially limited region is typically within a mass spectrometer, or adjacent space such as a region of an ionization source, where sample ions are confined and accumulated or pass through such that they are located within the region for a period of time before being transferred into an ion trap.

The static or dynamic electromagnetic ion trap may be Penning trap or three-dimensional Paul trap, or linear multipole trap, or Kingdon trap, or any other electromagnetic trap where conditions are created for efficient ion-electron reactions and vibrational excitation reactions.

A source may be provided for production of electrons outside or inside the electromagnetic ion trap, such as thermal emission from a hot surface, field emission, secondary electron emission or photoemission from a surface or gas-phase molecules. Means may be provided such as magnetic or electrostatic or electromagnetic field, or any combination thereof, for assisting ion-electron reactions. A means may also be provided for damping the motion of electrons and ions, both precursor and fragment, inside the spatially limited region, such as a buffer gas.

Analysis of fragment ions by their m/z values may use Fourier transform analysis of their motion frequencies inside the ion trap, m/z-selective ejection of ions from the trap, or unselective ejection of the ions from the trap to another m/z analyzer, such as a time-of-flight analyzer. The vibrational excitation of ions may be based on collisions with gas-phase neutrals, infrared multiphoton dissociation, or collisions with a surface.

The method of the invention for providing ion-electron reactions of precursor ions will in useful embodiments cause them to dissociate to provide fragment ions. Electron detachment dissociation utilizes the following ion-electron reaction:

$$[M-nH]^{n-}+e-\rightarrow[M-nH]^{(n-1)-}+2e-\rightarrow\text{fragmentation}$$

where multiply-deprotonated molecules $[M-nH]^{n-}$ ($n\geqq 2$) are provided, most suitably by electrospray ionization. (The parent ion needs to have a charge of 2 or higher, to obtain at least one charged fragment after ejection of an electron wherein the negative charge is decreased by one unit charge). The cross section of electron detachment reaches appreciable values above 10 eV and maximum around 20 eV, and therefore for effective reaction the electrons (or a substantial portion thereof) should preferably have kinetic energy between 10 and 20 eV, more preferably between 17 and 20 eV.

Electron capture dissociation utilizes the following ion-electron reaction:

$$[M+nH]^{n+}+e-\rightarrow\text{fragmentation}$$

where multiply-protonated molecules $[M+nH]^{n+}$ ($n\geqq 2$) are provided, most suitably by electrospray ionization. (The parent ion needs to have a charge of 2 or higher, to obtain at least one charged fragment after capture of an electron wherein the positive charge is decreased by one unit charge.) The cross section of electron capture rapidly decreases with electron energy, and therefore for effective reaction the electrons (or a substantial portion thereof) should preferably have kinetic energy below about 1 eV, more preferably below about 0.5 eV, and even more preferably about 0.2 eV or less. The cross section of electron capture is also quadratically dependent upon the ionic charge state, meaning that capture by doubly charged ions is four times more efficient than by singly-charged ions. Therefore, the less charged fragments that are formed from the parent ions, capture electrons with a very low rate compared with the parent ions.

In hot electron capture dissociation, the electrons should have energy in the range between 3 and 13 eV, more preferably around 11 eV. Such hot electrons are captured directly and simultaneously produce electronic excitation. The excess energy in HECD is typically dissipated in secondary fragmentation reactions, such as losses of H. and larger radical groups near the position of primary cleavage.

Ions suitably analyzed with the current invention include many different classes of chemical species that can be ionized to provide multiply charged ions, e.g., polymers, carbohydrates, and biopolymers, in particular proteins and peptides, including modified proteins and peptides.

It is postulated herein that, contrary to what has been suggested by the prior art, recording of tandem mass spectra with two different excitation techniques can be performed using one and the same ion population, by means of dissociating in the second reaction the unreacted precursor ions from the first reaction.

The present invention uses the fact that the highest fragmentation yield is achieved in fragmentation reactions, including ion-electron reactions, where some fraction (usually 10–30%) of the precursor ions remain unreacted. Moreover, the unreacted ions in ECD remain intact in terms of the primary and secondary structure, because the energy of the electrons used in ECD is too low to excite electronic or vibrational degrees of freedom in the ion that did not capture an electron. Although in ion-electron reactions that utilize higher electron energies than used in ECD, the secondary structure of unfragmented ions may change due to inelastic collisions with electrons, the primary structure of these ions is preserved, and thus VE fragmentation of these ions yields representative structural information.

This invention utilizes also the ability of ion trap mass spectrometers to select for m/z analysis a range of m/z values of ions of interest, while ions with m/z values outside this range can remain in the trap for further reactions. Another feature of tandem mass spectrometers used in this invention is the ability to accumulate precursor ions in a storage device while performing fragmentation and m/z analysis of a previously accumulated ion population. The present invention reaches this objective by utilizing for the VE fragmentation the fraction of precursor ions left undissociated in ion-electron reactions. The reverse order, that is first use of VE dissociation and then ion-electron reactions, is also possible but less advantageous because vibrational excitation is more difficult to control than ion-electron reaction.

In a preferred, useful embodiment the invention is implemented on a tandem mass spectrometer based on an ion trap. Such a tandem mass spectrometer comprises suitable means to select ions of desired mass to charge ratio to be located in the spatially limited region prior to the step of transferring the ions into the ion trap to perform electron-induced fragmentation and vibrational excitation dissociation, or alternatively to select ions after fragmentation reaction for subsequent fragmentation.

EXAMPLE 1

Tandem mass spectrometry using a Fourier transform ion cyclotron resonance mass spectrometer: The first particular embodiment is illustrated in FIG. 1 that presents a schematic diagram of a Fourier transform ion cyclotron resonance mass spectrometer. The mass spectrometer is composed of an electrospray ion source (1). The electrospray source has an atmosphere-vacuum interface (2). Ions formed in the spray chamber (3) by electrospray from the spray needle (4) enter the electrospray capillary (5). After the capillary, the ions pass the first skimmer (6) and the second skimmer (7), and enter a linear radiofrequency (RF) multipole ion trap used as ion accumulation multipole (8). Here, the ions are trapped radially by the RF multipole (8) and axially by the reflective potentials of the second skimmer (6) and the trap/extract electrode (9). Ions can be accumulated in this linear multipole ion trap and then extracted at a pre-determined time by changing the polarity of the trap/extract electrode (9) and transferred later into the ion transfer optics (10) into the ion cyclotron resonance (ICR) trap (11), which is placed in a strong magnetic field generated by a superconducting magnet (12). The ion transfer optics (10) can be an electrostatic ion lens and deflector system, or another multipole ion guide system. The complete system is in a differentially pumped vacuum housing (13) which allows a drop of pressure from atmospheric pressure at the ion source (1) gradually down to approximately $10^{-10}$ millibar at the ultra high vacuum part (14) in the magnet, where the ICR trap (11) is placed. FIG. 1 shows only the pump connections (15) of the vacuum housing but not the pumps. A data station (16) controls the complete Fourier transform ICR spectrometer system.

Positive ions produced continuously by the electrospray source (1) are accumulated in the linear RF multipole trap (8). At the beginning of each analysis cycle, the positive potential of the trap/extract electrode (9) is of sufficiently high value, so that the ions cannot pass this electrode and remain trapped in the multipole (8). The duration of this accumulation period depends on the ion current (shorter period for higher current) and the desired number of accumulated ions, the potential of the trap/extract electrode (9) is made sufficiently negative, so that the trapped ions pass through the trap/extract electrode (9) and through the ion transfer optics (10), reach the ICR trap (11). The ions are captured and trapped in the ICR trap (11) by one of the conventional methods, such as sidekick, or gated trapping, or gas-assisted trapping. Immediately after the ions are trapped in the ICR trap (11) the polarity of the potential on the trap/extract electrode (11) is made again blocking for the ions, in order to start a new storage period. The mass-to-charge ratio (m/z) of the precursor ions for dissociation is selected either in the storage multipole (8) during the accumulation period, or in the ion transfer optics (10) during the ion transfer, or in the ICR trap (11) following the ion trapping. After that, the electron source (17) produces an electron beam (18) of suitable energy, which passes through the ICR trap (11) and interacts with the trapped ions, upon which a number of ions undergo electron capture dissociation (ECD). After a period of time sufficient to provide efficient ion-electron reaction, but not long enough to dissociate all the precursor ions, the cyclotron motion of the ions in the ICR trap is excited to sufficiently high orbits. The excitation frequencies are selected in such a way that the ions with m/z equal to and near to the m/z of the precursor ions remain unexcited. This is performed by one of the conventional techniques for selective ion cyclotron orbit excitation, such as stored waveform inverse Fourier transform (SWIFT) technique, correlated sweep technique, or others. After that, the frequencies of ion motion are detected by induced image currents, as is customary in the FTICR mass spectrometry. The spectrum of detected frequencies is stored in the computer memory of the data system (16). After the frequency measurements, the fragment ions may be ejected from the ICR trap (11) by applying the same or different cyclotron orbit excitation technique. Now the IR laser (19) emits for a period of time a beam of photons (20) that passes the IR window (21) and is sufficiently intense to produce infrared multiphoton dissociation (IRMPD) of the ions remaining intact (precursor ions) in the ICR trap after irradiation with electrons. Another cyclotron orbit excitation event is now produced followed by the frequency detection event. Again, a frequency spectrum is acquired and stored in the computer memory of the data station (16). After obtaining of two subsequent tandem mass spectra from the same population of precursor ions, the data station (16) initiates the "quench pulse" which purges the remaining ions from the ICR trap (11) and begins another cycle of measurements by lowering the potential on the trap/extract electrode (9). Since during both fragmentation events the ions are continuously accumulated in the accumulation multipole (8), no ion current is wasted and the analysis can be performed with a higher sensitivity than suggested by the prior art, where two accumulation periods are needed for performing the two fragmentation experiments.

The electron source (17) shown in this figure is a hollow cathode which allows the laser beam go through its bore. However any setup capable of exposing the ions in the ICR trap to electrons and photons can be used in the experiments. One of the other methods is the use of an on-axis electron source and an angled on-axis laser beam. Another possible setup would be an off-axis electron source and an on-axis laser beam.

Figure 2:
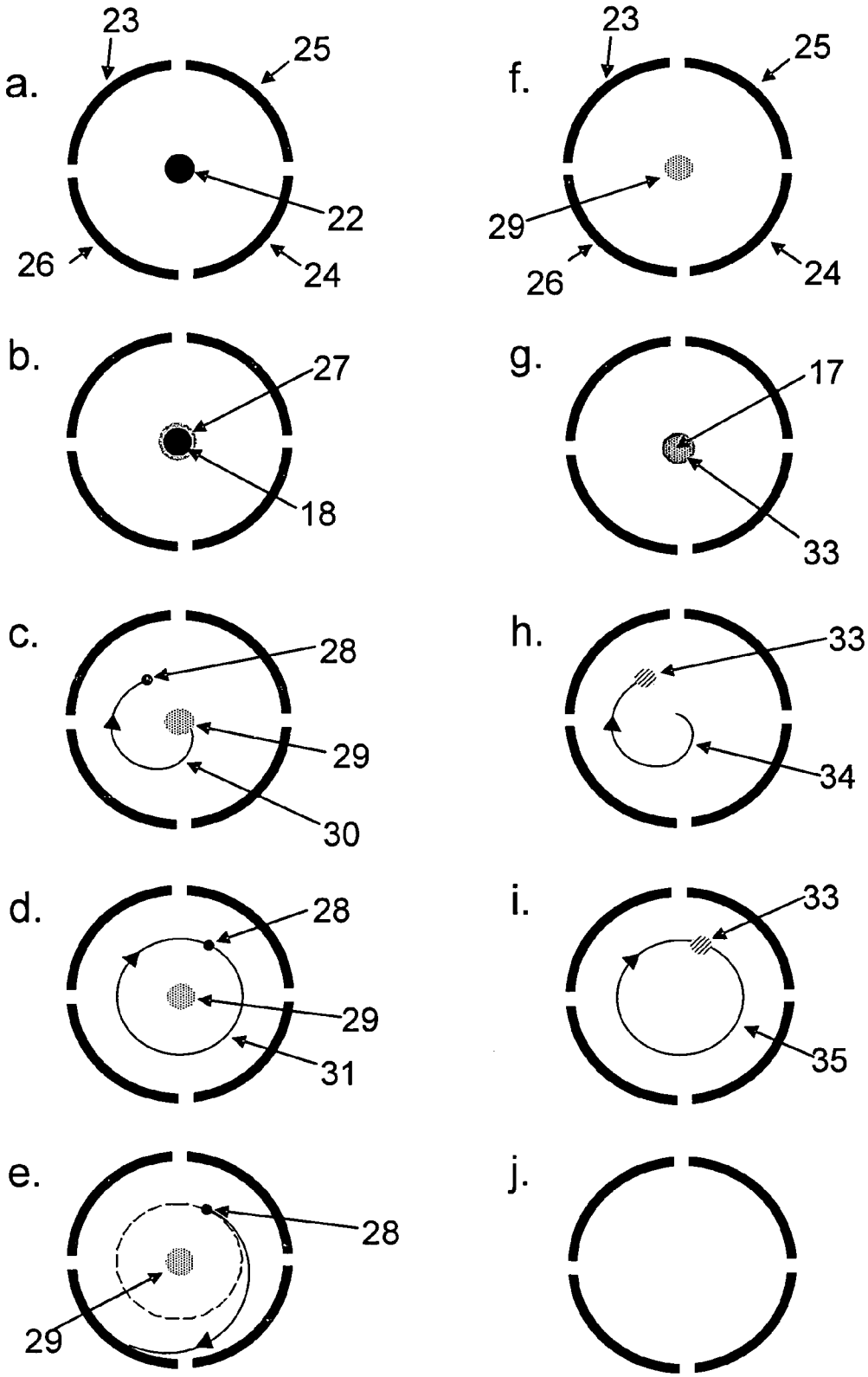
FIG. 2 shows the work flow diagram in an ion cyclotron resonance trap according to the present invention.

FIG. 2 shows a cross section of the ICR trap in order to describe the events inside the trap closer: Multiply charged ions (e.g., multiply protonated polypeptide ions) are generated in an electrospray source, introduced into an ICR trap and captured there. Trapped ions (22) are shown in the schematic cross sectional view in FIG. 2*a*. In the cross sectional view of the ICR trap, the excitation electrodes of the ICR trap (23) and (24) as well as, the detection plates (25) and (26) are shown. The ions are then exposed to an electron beam (18) in order to perform electron capture dissociation (FIG. 2*b*) and the a part of the ions dissociate and produce fragment ions. After this process, the ion ensemble (27), shown in the center of the ICR trap, consists now of a mixture of the dissociation products and the parent (precursor) ions (29) that remained undissociated. At this point the product ions are exposed to a selective broadband excitation using a special excitation routine which does not excite the parent ions (FIG. 2*c*). The product ions (28) of the electron capture dissociation become separated from the remaining parent ions (29) and follow the cyclotron excitation path (30). When the excitation pulse stops (FIG. 2*d*), the excited product ions now circle in larger orbits (31). The detection of these ions (28) is performed by acquiring, amplifying, recording, and analyzing the image currents generated in the detector plates (25, 26) by these ions. The undissociated parent ions (29) circle in unexcited cyclotron orbits. The detected product ions are now further excited using the same selected broadband excitation in order to let them eject them out of the ICR trap (FIG. 2*e*). Thus, the elimination process of the detected product ions does not affect the remaining parent ions (29) that are still circling on small orbits near the center of the trap (FIG. 2*f*). In the next stage of the experiment (FIG. 2*g*), the remaining parent ions are exposed to the infrared laser beam (17). Upon this irradiation, a multiphoton absorption takes place and the ions dissociate (IRMPD). The ensemble (33) consisting of the IR-dissociated ions and the parent ions are non-selectively broadband-excited (34) and detected (FIGS. 2*h* and 2*i*) using the image currents they generate in the detector plates (25 and 26) while they are orbiting (35) at the excited levels. Finally, the detected ions are eliminated by quenching the ICR trap using a DC voltage pulse at one of the trapping electrodes (not shown in the Figure). After elimination of the ions, the ICR trap is ready for the introduction of new ions (FIG. 2*j*).

EXAMPLE 2

Figure 3:
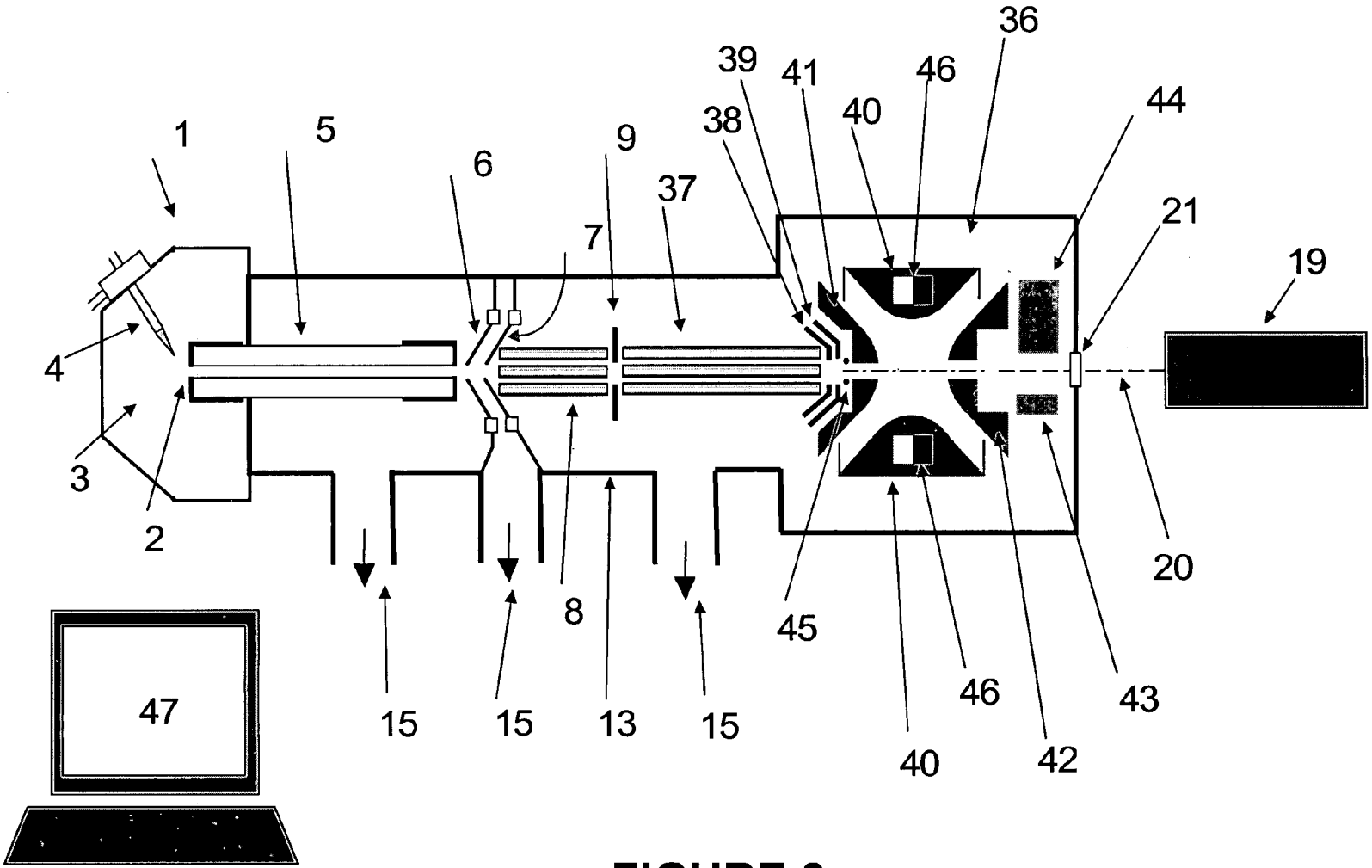
FIG. 3 shows a radio frequency (RF) ion trap instrument for doing electron capture reactions equipped with a linear multipole ion trap for pre-accumulating the ions.

A tandem mass spectrometry method may take place in a three-dimensional quadrupole ion trap mass spectrometer. Similar to the method applied in Fourier transform ion cyclotron resonance mass spectrometry in a radiofrequency quadrupole trap (Paul trap) mass spectrometer, ions can be generated by electrospray and before they are transferred into the trap for analysis, they can be accumulated in a spatially limited region, in a radiofrequency multipole which is used as a linear trap. FIG. 3 shows such a system. (1) is the electrospray ion source, (2) is the vacuum interface, the entrance of the electrospray capillary (5). The sample is sprayed through a spray needle (4) in the spray chamber (5). Ions pass through the electrospray capillary (5) and two skimmers (6) and (7) and enter the linear radiofrequency multipole trap (8) for accumulation. The trap/extract electrode (9) has a positive voltage to trap positive ions in the linear multipole (8). After a desired time of accumulation, the ions are transferred into the Paul trap (36) passing through the ion transfer optics (37). This includes, in this particular example, a multipole ion guide (37), having at the end lens electrodes (38) and (39). FIG. 3 also shows a schematic cross sectional drawing of the Paul trap (36). In the figure, the cross section of the ring electrode (40) and the end caps (41) and (42) is shown schematically. Ions pass through the lenses (38) and (39) and enter the Paul trap (36). For the mass analysis, detection ions are ejected by any ion trap scan such as a mass selective radiofrequency scan through the hole out of the trap and detected. Also shown are a conversion dynode (43) and a detector (44). The mass spectrometer system is controlled by the data station (47). Electrons are generated by activating one or all of the filaments (45) and injected into the trap. A magnet or magnets (46) placed into the ring electrode (40) help directing the electrons into the trap.

In the experiment, the ions are generated in the electrospray source (1) and accumulated in the hexapole (8). The accumulated ions are subsequently injected into the Paul trap (36) by reversing the potential at the trap/extract electrode (9). The ions trapped in the Paul trap (36) are then exposed to the electrons of suitable energy generated by the filaments (45). These electrons interact with the trapped ions. After a period of time sufficient to provide efficient ion-electron reaction, but not long enough to dissociate all the precursor ions, the product ions in the Paul trap (36) are mass selectively ejected for detection without ejecting the remaining parent ions. The spectrum of detected ions is stored in the computer memory of the data system (47). After that, the IR laser (19) emits for a period of time a beam of photons (20) that passes the IR window (21) and is sufficiently intense to produce infrared multiphoton dissociation (IRMPD) of the ions remaining intact (precursor ions) in the Paul trap (36) after irradiation with electrons. Another ejection and detection leads to the IRMPD mass spectrom of ions, which stored in the computer memory of the data station (47). After obtaining of two subsequent tandem mass spectra from the same population of precursor ions, the data station (47) initiates a pulse to purge the remaining ions from the Paul trap (36) and begins another cycle of measurements by lowering the potential on the trap/extract electrode (9). Since during both fragmentation events the ions are continuously accumulated in the accumulation multipole (8), no ion current is wasted and the analysis can be performed with a higher sensitivity than suggested by the prior art, where two accumulation periods are needed for performing the two fragmentation experiments.

Figure 4:
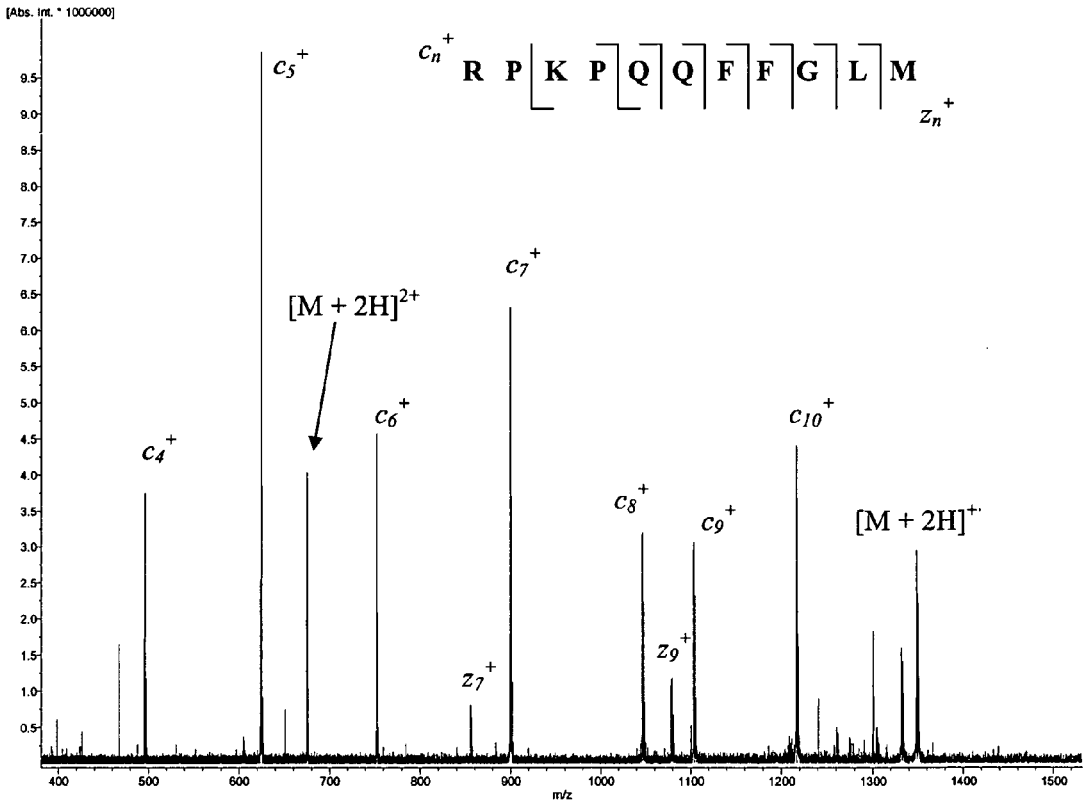
FIG. 4 shows an experimentally obtained FTICR mass spectrum showing the electron capture dissociation fragments of doubly protonated molecule of substance P after excitation and detection of fragments only.

FIG. 4 shows the FTICR mass spectrum of doubly charged positive ions obtained from the compound substance P, acquired after 50 ms of electron capture dissociation (ECD) with selective excitation of cyclotron frequencies of all ions except the precursor ions, the doubly protonated molecule $[M+2H]^{2+}$ at mass to charge ratio m/z 674. A low intensity signal is still detected due to the parasitic sideband excitation.

Figure 5:
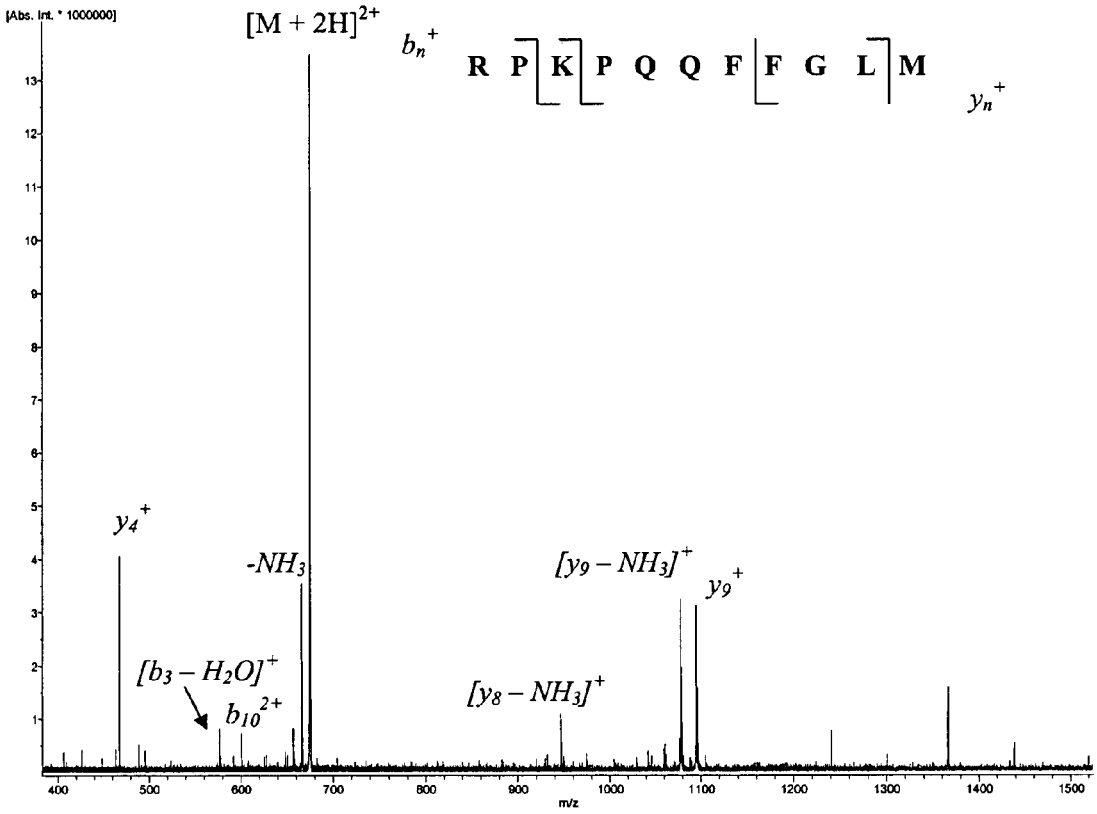
FIG. 5 shows an experimentally obtained FTICR mass spectrum with the infrared multiphoton dissociation fragments of doubly protonated substance P molecules, which did not undergo electron capture dissociation.

FIG. 5 shows the FTICR mass spectrum after infrared multiphoton dissociation (IRMPD) of the doubly protonated molecules of substance P, which did not undergo electron capture dissociation (ECD) during the 50 ms-long interaction (FIG. 4) with the electrons. The spectrum was acquired with a broadband excitation of cyclotron frequencies of all ions.

The method in the present invention allows the sequential application of two different fragmentation methods, electron capture dissociation and vibrational excitation dissociation onto the same ensemble of ions in the ICR trap. The method is often applied in a way that the fragmentation of primary ions by electron capture is performed first. After the cyclotron excitation and detection of the ECD fragments, the remaining undissociated primary ions undergo vibrational excitation, for instance by being exposed to an infrared laser beam. The fragment ions of the second step are also excited and detected. However, the order of these two steps can be switched, that is, the primary ions can be vibrationally excited first, after which a part of them undergo fragmentation. The fragment ions can be excited and detected without exciting the remaining undissociated primary ions. The undissociated ions can now be exposed to an electron beam and dissociated by electron capture. The electron capture dissociation products are then also excited and detected.

The electron capture dissociation of ions normally occurs by interaction with free electrons. However, multiply positive charged ions (as in multiply protonated species) can also interact with negative ions where an electron of the negative ion is "captured" by this multiply charged positive ion. This process may also lead to an electron capture dissociation of the positive ion. Thus, not necessarily free electrons can be used for the electron capture dissociation, but also electrons attached to molecules or radicals with sufficiently high electron affinity, thus forming anions.

What is claimed is:

1. Method of tandem mass spectrometry comprising the steps of a) accumulating positive or negative sample ions for a period of time in an ion trap;

b) providing a cloud of electrons inside the trap with sufficiently low kinetic energy, below approximately 100 eV, to allow ion-electron reactions by which a fraction of the ions, but not all ions, dissociate into fragment ions;

c) detecting the mass-to-charge ratios of the fragment ions, whereby the undissociated ions remain inside the trap during and after the detection;

d) exciting the undissociated ions vibrationally, whereby at least some of the ions dissociate into fragment ions; and e) detecting the mass-to-charge ratios of the fragment ions, thus allowing recordings of fragment mass spectra from both ion-electron reactions and vibrational excitation from the same accumulation of sample ions.

2. Method according to claim 1, wherein the ion-electron reactions are performed by electron capture dissociation, hot electron capture dissociation, electron detachment dissociation, electronic excitation, or electron ionization.

3. Method according to claim 2, wherein the ions are of positive polarity and at least a portion of electrons has either an energy below 3 eV to enable electron capture dissociation, or an energy in the range of 3 eV to 50 eV to enable hot electron capture dissociation.

4. Method according to claim 2, wherein the ions are of negative polarity and at least a portion of electrons has an energy in the range of about 10 to about 100 eV to enable electron detachment dissociation.

5. Method according to claim 2, wherein the gas pressure is increased in the ion trap during the time of electron-ion reactions.

6. Method according to claim 2, wherein the precursor ions remaining undissociated during vibrational excitation remain inside said trap during and after detection of said vibrational excitation fragment ions.

7. Method according to claim 1, wherein the vibrational excitation is performed by ion-neutral collisions, ion-electron collisions, infrared photon absorption, visible photon absorption, or ultraviolet photon absorption.

8. Method according to claim 1, wherein after detecting the mass-to-charge ratios of said fragment ions formed after said ion-electron interactions, the fragment ions are eliminated from the ion trap before vibrationally exciting said undissociated ions and detecting the mass to charge ratios of said vibrational excitation fragment ions, thus allowing separate recordings of fragment mass spectra from both ion-electron reactions and vibrational excitation dissociations from the same accumulation of sample ions.

9. Method according to claim 1, wherein multiply-charged ions of desired mass to charge ratio are selected prior to the ion-electron reactions.

10. Method according to claim 1, wherein multiply-charged ions are provided by electrospray ionization.

11. Method according to claim 1, wherein the ion trap is a three-dimensional radiofrequency ion trap, a linear radiofrequency multipole ion trap, or an ion cyclotron resonance ion trap.

12. Method according to claim 1, wherein a multitude of frequencies applied for selective excitation of the motion of the fragment ions, which does not include the frequencies close to the resonance frequency of the undissociated ions, so that these ions remain in the trap.

13. Method according to claim 1, wherein the ions are accumulated in a spatially limited region before they are transferred into the ion trap.

14. Method according to claim 13, wherein the spatially limited region is a three-dimensional radiofrequency ion trap, a linear radiofrequency multipole ion trap, or an ion cyclotron resonance ion trap.

15. Method according to claim 13, where the spatially limited region can be used for mass selectively isolating the ions.

16. Method according to claim 13, where the spatially limited region can be used for fragmenting the ions.

17. Method according to claim 13, where the ions in the spatially limited region can be mass selectively detected by a local detector.

18. Method according to claim 13, wherein the sample ions are transported to the ion trap, captured and trapped there by a technique that provides an efficient transfer and capture of ions without causing loss of ions, that were already trapped there, which technique can be gated trapping, side-kick trapping, gas-assisted trapping or any other appropriate technique.

19. Method according to claim 1, where the electrons are not free electrons but attached to molecules or radicals with sufficiently high electron affinity thus forming anions.

20. Method of tandem mass spectrometry comprising the steps of a) accumulating positive or negative sample ions for a period of time in an ion trap;

b) exciting the ions vibrationally, by which a fraction of the ions, but not all ions, dissociate into fragment ions;

c) detecting the mass-to-charge ratios of the fragment ions, whereby the undissociated ions remain inside the trap during and after the detection;

d) providing a cloud of electrons inside the trap with sufficiently low kinetic energy, below approximately 100 eV, to allow the undissociated ions to react with electrons, by which a fraction of the ions, but not all ions, dissociate into fragment ions; and e) detecting the mass-to-charge ratios of the fragment ions, thus allowing recordings of fragment mass spectra from both vibrational excitation and ion-electron reactions of the same accumulation of sample ions.

21. Method according to claim 20, wherein after detecting the mass-to-charge ratios of said fragment ions formed after said dissociation by vibrational excitation, the fragment ions are eliminated from the ion trap before the letting said undissociated ions interact with electrons and detecting the mass to charge ratios of the fragment ions produced by said ion-electron interactions, thus allowing separate recordings of fragment mass spectra from both vibrational excitation dissociations and ion-electron reactions from the same accumulation of sample ions.

22. Method according to claim 20, wherein the ions are accumulated in a spatially limited region before they are transferred into the ion trap, whereby said spatially limited region can be a three dimensional radiofrequency ion trap, a linear radiofrequency multipole ion trap, or an ion cyclotron resonance trap.

23. Method according to claim 22, where the spatially limited region can be used for mass selectively isolating the ions.

24. Method according to claim 22, where the spatially limited region can be used for fragmenting the ions.

25. Method according to claim 22, where the ions in the spatially limited region can be mass selectively detected by a local detector.

26. Method according to claim 20, where the electrons are not free electrons but attached to molecules or radicals with sufficiently high electron affinity thus forming anions.

27. Method of tandem mass spectrometry comprising the steps of:

a) accumulating positive or negative sample ions for a period of time in an ion trap;

b) providing a cloud of negative ions inside the trap to allow ion—ion reactions by which the negative ions transfer an electron to a fraction of the positive ions, but not to all of the positive ions, upon which positive ions dissociate into fragment ions;

c) detecting the mass-to-charge ratios of the fragment ions, whereby the undissociated ions remain inside the trap during and after the detection;

d) exciting the undissociated ions vibrationally, whereby at least some of the ions dissociate into fragment ions; and e) detecting the mass-to-charge ratios of the fragment ions, thus allowing recordings of fragment mass spectra from both ion-electron reactions and vibrational excitation from the same accumulation of sample ions.

* * * * *